US008650793B1

(12) United States Patent
Mendez

(10) Patent No.: US 8,650,793 B1
(45) Date of Patent: Feb. 18, 2014

(54) GUN RAIL ARTICLE

(76) Inventor: Angel Mendez, Raeford, NC (US)

( * ) Notice: Subject to any disclaimer, the term of this patent is extended or adjusted under 35 U.S.C. 154(b) by 230 days.

(21) Appl. No.: 13/108,362

(22) Filed: May 16, 2011

(51) Int. Cl.
*F41C 27/00* (2006.01)

(52) U.S. Cl.
USPC ..... 42/90

(58) Field of Classification Search
USPC ..... 42/90, 71.01, 72, 73, 85, 96, 99, 106, 42/71.02, 124–128
See application file for complete search history.

(56) References Cited

U.S. PATENT DOCUMENTS

| | | | | | |
|---|---|---|---|---|---|
| 1,288,977 | A | * | 12/1918 | Palmer | 42/126 |
| 2,007,019 | A | | 7/1935 | Lowe | |
| 2,308,627 | A | * | 1/1943 | Rickenbacher | 42/71.02 |
| 2,717,447 | A | * | 9/1955 | Leupold | 42/127 |
| 2,857,675 | A | * | 10/1958 | Kesselring | 42/127 |
| 3,259,986 | A | * | 7/1966 | Carr | 42/124 |
| 3,393,423 | A | * | 7/1968 | Adams | 16/444 |
| 3,405,448 | A | * | 10/1968 | Weatherby | 42/127 |
| 3,579,840 | A | * | 5/1971 | Heinzel | 42/127 |
| 3,671,000 | A | * | 6/1972 | Williams | 248/205.1 |
| 4,346,530 | A | * | 8/1982 | Stewart et al. | 42/71.01 |
| 4,674,216 | A | * | 6/1987 | Ruger et al. | 42/71.01 |
| 4,688,345 | A | * | 8/1987 | Kilgour | 42/127 |
| 4,860,480 | A | * | 8/1989 | Ruger | 42/124 |
| 4,934,085 | A | * | 6/1990 | Lough | 42/127 |
| 5,406,730 | A | | 4/1995 | Sayre | |
| 5,428,915 | A | * | 7/1995 | King | 42/126 |
| 5,546,691 | A | | 8/1996 | Allison | |
| 5,792,516 | A | | 8/1998 | Beretta | |
| 5,986,562 | A | | 11/1999 | Nikolich | |
| 6,598,333 | B1 | * | 7/2003 | Randazzo et al. | 42/127 |
| 6,725,594 | B2 | * | 4/2004 | Hines | 42/90 |
| 6,782,652 | B1 | * | 8/2004 | Erickson | 42/143 |
| 6,836,990 | B2 | * | 1/2005 | Shiloni | 42/96 |
| 7,818,912 | B1 | * | 10/2010 | Thomas | 42/124 |
| 7,856,749 | B2 | * | 12/2010 | Fitzpatrick et al. | 42/96 |
| 7,880,793 | B2 | | 2/2011 | Holmberg | |
| 7,971,383 | B2 | * | 7/2011 | Fitzpatrick et al. | 42/96 |
| 2001/0027620 | A1 | * | 10/2001 | Wooten et al. | 42/124 |
| 2003/0106252 | A1 | * | 6/2003 | Hines | 42/90 |
| 2004/0035991 | A1 | * | 2/2004 | Wooten et al. | 248/229.1 |
| 2004/0064994 | A1 | * | 4/2004 | Luke | 42/85 |
| 2004/0226212 | A1 | * | 11/2004 | Shiloni | 42/96 |
| 2005/0217161 | A1 | | 10/2005 | Haugen et al. | |
| 2006/0075672 | A1 | * | 4/2006 | Romer | 42/10 |
| 2009/0241397 | A1 | * | 10/2009 | Fitzpatrick et al. | 42/90 |
| 2009/0307954 | A1 | | 12/2009 | Wang | |
| 2010/0218410 | A1 | | 9/2010 | Cabahug et al. | |
| 2010/0236124 | A1 | * | 9/2010 | Troy | 42/90 |
| 2011/0099879 | A1 | * | 5/2011 | Fitzpatrick et al. | 42/90 |
| 2012/0085013 | A1 | * | 4/2012 | Cahill | 42/96 |
| 2012/0266514 | A1 | * | 10/2012 | Michal et al. | 42/90 |

FOREIGN PATENT DOCUMENTS

| | | | | |
|---|---|---|---|---|
| WO | WO2006/041349 | | 4/2006 | |
| WO | WO 2006041349 | A1 * | 4/2006 | F41G 1/387 |

* cited by examiner

*Primary Examiner* — Michael Carone
*Assistant Examiner* — Jonathan C Weber
(74) *Attorney, Agent, or Firm* — Michael I. Kroll

(57) ABSTRACT

A gun rail accessory comprising housing having a bottom side with vertically extending exterior walls to a top side image area with said bottom side having a channel extending between opposing walls and wherein at least one housing side wall has a pair of spaced fasteners movable to engage channel resident flexible locking tabs thereby enabling the anchoring of the accessory to the gun rail.

6 Claims, 13 Drawing Sheets

GUN RAIL ARTICLE

BACKGROUND OF THE INVENTION

1. Field of the Invention

The present invention relates generally to firearms and, more specifically, to an attachable accessory for a firearm gun rail.

Gun rails are brackets fastenable to firearms, such as, rifles and handguns for the purpose of attaching accessories, such as scopes, lasers, lights, etc. to the firearm. The rail portion is standardized while the bracket portion is manufactured in a variety of fastening elements and configurations dependant on the type of firearm and the gun rail may comprise a plurality of spaced rails for attachment of a plurality of accessories.

The present invention provides a gun rail article comprising housing having an attachment portion with vertically extending exterior walls to an image portion with said attachment portion having a channel extending between opposing walls and wherein at least one housing side wall has a pair of spaced fasteners movable to engage channel resident flexible locking tabs thereby enabling the anchoring of the gun rail article to the gun rail.

2. Description of the Prior Art

There are other mountable devices designed for gun rails.

While these devices may be suitable for the purposes for which they where designed, they would not be as suitable for the purposes of the present invention as heretofore described.

It is thus desirable to provide a gun rail article having an image portion and an attachment portion mountable to a gun rail forming an ornamental or accessory device for a gun rail.

It is further desirable to provide a gun rail article wherein said image portion and said attachment portion may be separable for varying the image portion of said gun rail article.

SUMMARY OF THE PRESENT INVENTION

A primary object of the present invention is to provide a gun rail article as an ornament or accessory for a gun rail.

Another object of the present invention is to provide a gun rail article having housing comprising a top portion forming an image portion, bottom portion forming attachment portion and opposing side walls.

Yet another object of the present invention is to provide a gun rail article wherein said attachment portion has a linear channel for receiving said gun rail.

Still yet another object of the present invention is to provide a gun rail article wherein said channel abuts a pair of free standing linearly aligned flexible tabs.

Another object of the present invention is to provide a gun rail article having a pair of exterior fasteners that are movable to engage said flexible tabs thereby fastening said article to the gun rail.

Yet another object of the present invention is to provide a gun rail article wherein said channel can incorporate a plurality of spaced apart ribs matable to the gun rail.

Still yet another object of the present invention is to provide a gun rail article wherein said image portion can incorporate an image receptacle having a peripheral ridge for receiving a user provided article therein.

Another object of the present invention is to provide a gun rail article wherein said image receptacle has a pair of spaced apart fastener apertures whereby said user provided article can be threadely attached thereto.

Yet another object of the present invention is to provide a gun rail article wherein said image portion can be removable from said attachment portion having said channel therein.

Still yet another object of the present invention is to provide a gun rail article wherein said image portion may be a sculptured or cast high relief or low relief.

Another object of the present invention is to provide a gun rail article wherein said image portion relief can be selectively removable by fastener or permanently bonded to said bottom side.

Additional objects of the present invention will appear as the description proceeds.

The present invention overcomes the shortcomings of the prior art by providing a gun rail accessory comprising housing having a bottom side with vertically extending exterior walls to a top side image area with said bottom side having a channel extending between opposing walls and wherein at least one housing side wall has a pair of spaced fasteners movable to engage channel resident flexible locking tabs thereby enabling the anchoring of the accessory to the gun rail.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 12A:
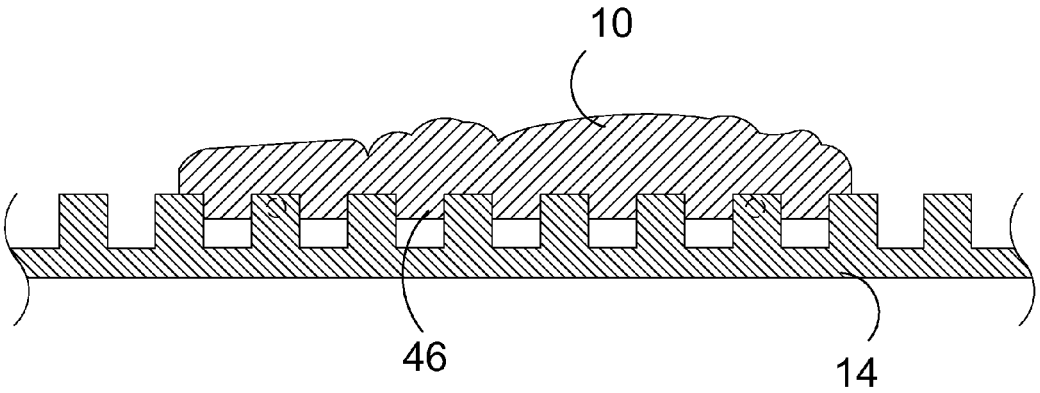
Figure 12B:
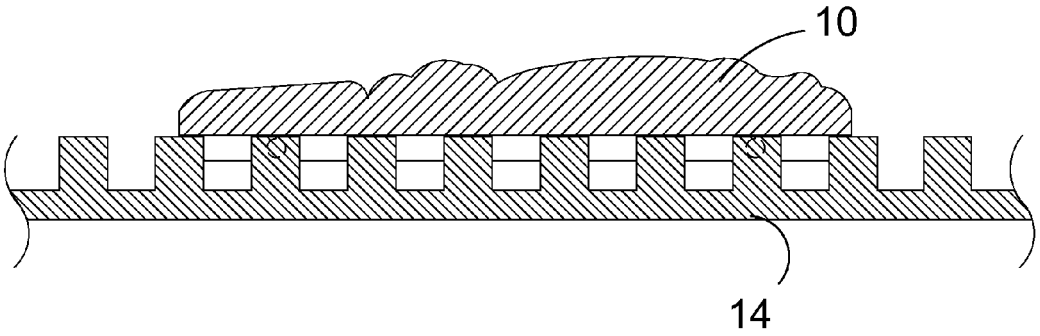

FIGS. 12A and 12B a partial cross sectional view of the gun rail article of the present invention.

Figure 13A:
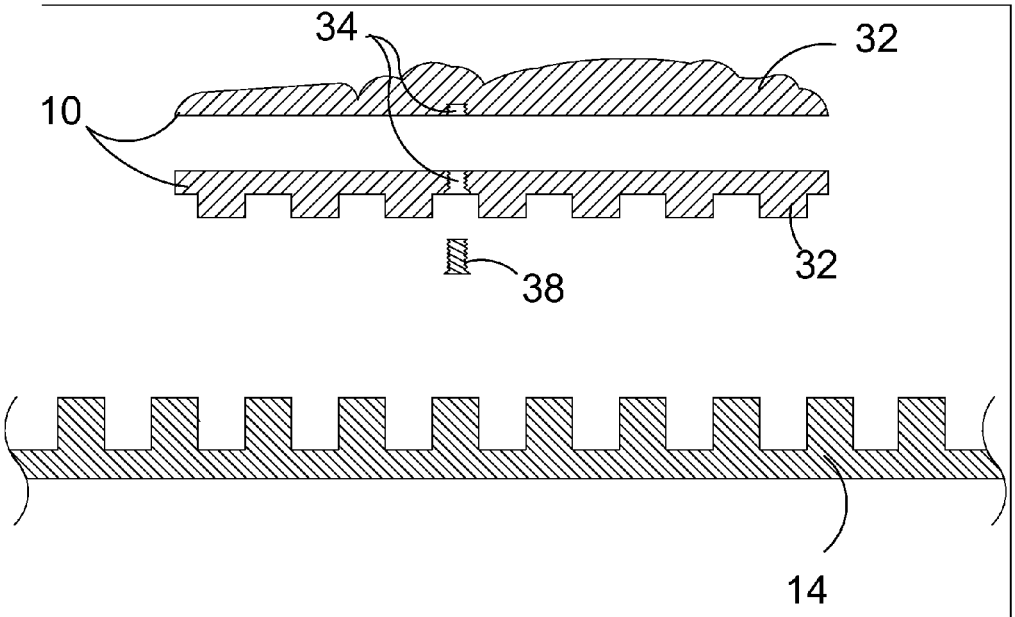
Figure 13B:
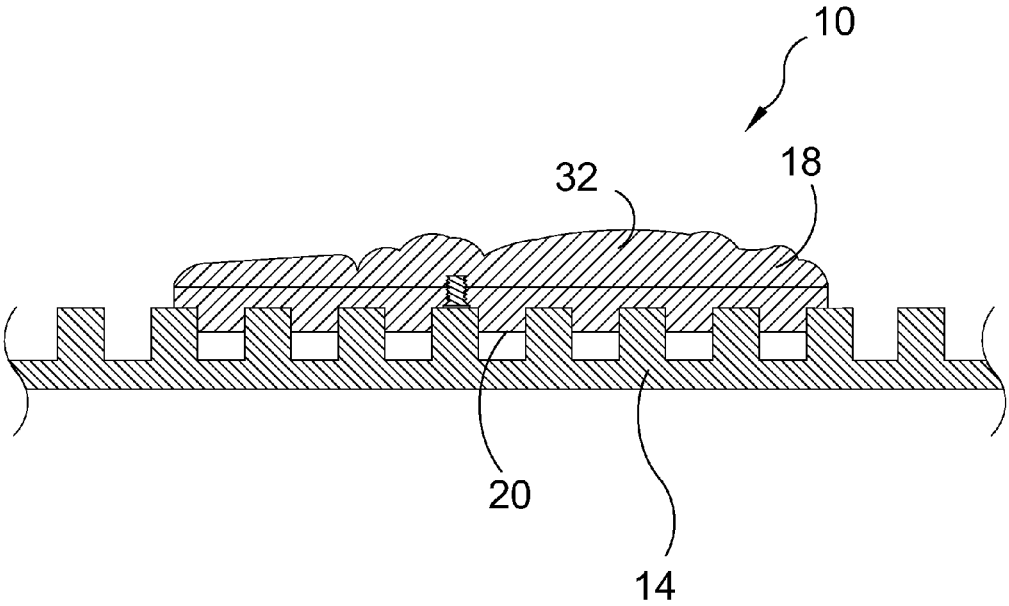

FIGS. 13A and 13B are partial cross sectional views of the gun rail mountable article of the present invention.

DESCRIPTION OF THE REFERENCED NUMERALS

Turning now descriptively to the drawings, in which similar reference characters denote similar elements throughout the several views, the figures illustrate the Gun Rail Mountable Article of the present invention. With regard to the reference numerals used, the following numbering is used throughout the various drawing figures.

10 Gun Rail Mountable Article of the present invention
12 weapon
14 gun rail
16 housing of 10
18 image portion of 16
20 attachment portion of 16
22 weapon barrel
24 ventilated barrel shroud
26 heat insulator
28 image portion receptacle
30 receptacle ridge
32 design plate
34 design plate fastener aperture
35 threaded fastener aperture of 18
36 gun rail attachment fastener
37 gun rail fastener aperture
40 article mounting channel
42 transverse channel ribs of 14
44 flexible tab
46 article rib
48 bonding element
50 upper flange of 20
52 lower flange of 20

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
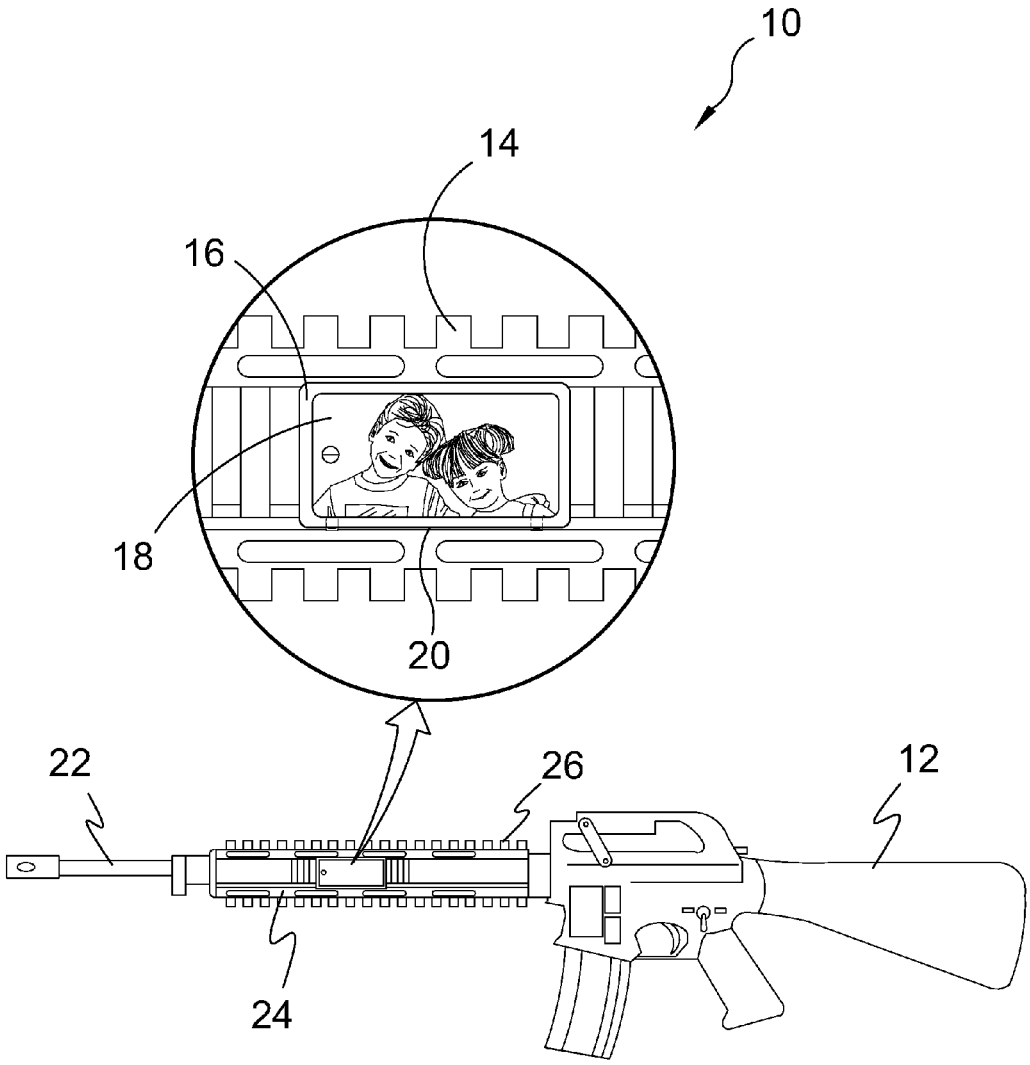
FIG. 1 is an illustrative view of the gun rail mountable article of the present invention.

FIG. 1 is an illustrative view of the gun rail mountable article 10 of the present invention. The gun rail mountable article 10 used to identify or personalize any weapon 12 of a gun rail 14 using the Picatinny or Weaver rail system. The article 10 comprises housing 16 having an image portion 18 and an attachment portion 20. The image portion 18 provides for a plurality of selectable reliefs where the relief may be separable from the attachment portion 18 and fastened thereto by fastener or an image portion receptacle that receives anything from military style dog tags to Velcro patches or customized logos held within said receptacle by fastener. Also shown is the barrel 22, ventilated barrel shroud 24 and heat insulator 26 of the weapon 12.

Figure 2:
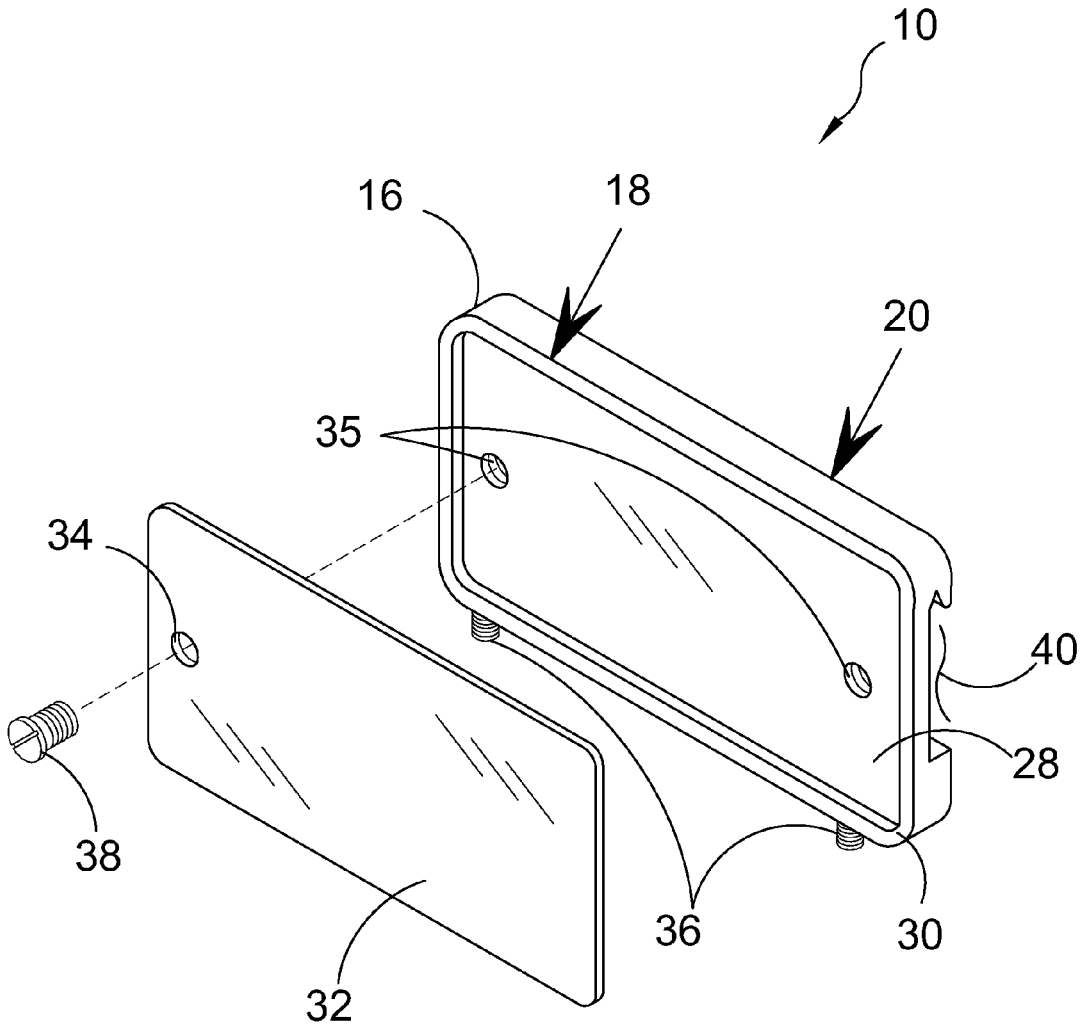
FIG. 2 is a perspective view of the gun rail article of the present invention.

FIG. 2 is a perspective view of the gun rail article 10 of the present invention. Shown is the gun rail article 10 having housing 16 incorporating an image portion 18 and an attachment portion 20 having means for gun rail article attachment to a gun rail. Illustrated is an embodiment where the image portion 18 has an image portion receptacle 28 with a peripheral receptacle ridge 30 for receiving a design plate 32 therein that may have letters, numbers, graphic design or picture thereon. The design plate 32 has a fastener aperture 34 and image portion receptacle 28 has a pair of threaded fastener 35 coaligned therewith for fixing the design plate 32 to the image portion receptacle 28 with a design plate fastener 38. Furthermore, the image portion receptacle 28 has a fastener aperture 35 on the opposing end so that the design plate 32 can be rotated 180 degrees and fastened to the other threaded fastener aperture 35 whereby the gun rail article 10 can be mounted to a weapon's left side gun rail or right side gun rail within the article mounting channel 40 and secured thereto with gun rail attachment fasteners 36 to accommodate viewing the design plate 32 in a desired orientation.

Figure 3:
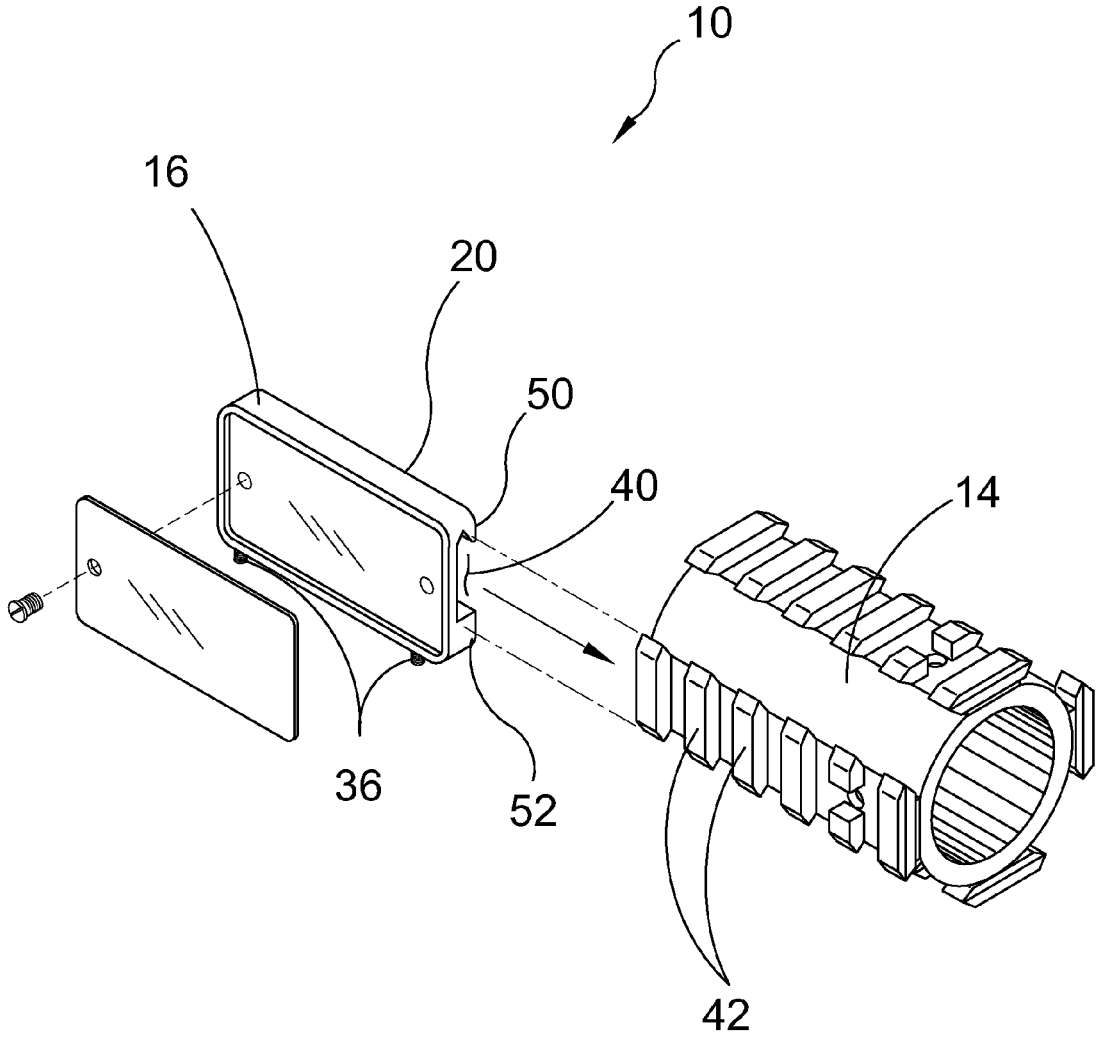
FIG. 3 is an exploded perspective view of the gun rail article of the present invention slidably mountable to a gun rail.

FIG. 3 is an exploded perspective view of the gun rail article 10 of the present invention slidably mountable to a gun rail 14. The gun rail article 10 incorporates an article attachment portion 20 with an article mounting channel 40 defined by a beveled upper flange 50 and a perpendicular lower flange 52 projecting therefrom providing means for mounting the gun rail article 10 to a gun rail 14 either by sliding the article mounting channel 40 onto the gun rail and securing it thereto with gun rail attachment fasteners 36 or if transverse channel ribs 42 are provided, by snapping the gun rail article 10 onto the gun rail 14. In either case, the gun rail article housing 16 incorporates side wall mounted gun rail attachment fasteners 36 for fixing the gun rail article 10 to the gun rail 14 once positioned to a desired location.

Figure 4:
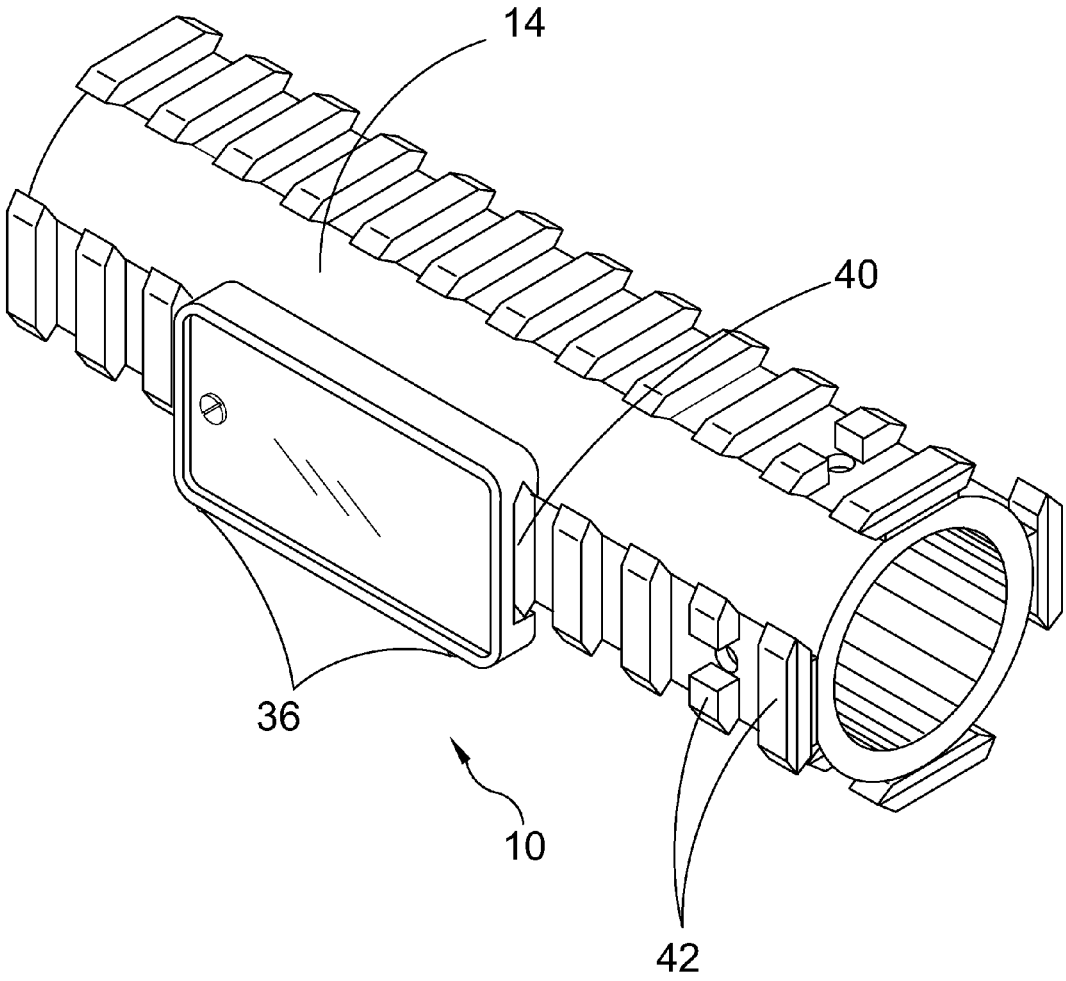
FIG. 4 is an assembly view of the gun rail article of the present invention mounted to a gun rail.

FIG. 4 is an assembly view of the gun rail article 10 of the present invention mounted to a gun rail 14. The gun rail article 10 is mountable to a gun rail 14 either by sliding the article mounting channel 40 of the gun rail article 10 onto the transverse ribs 42 within the channel mounting means then by snapping the gun rail article 10 onto the gun rail 14. Gun rail attachment fasteners 36 provide means for fixing the gun rail article 10 to the gun rail 14 once positioned at a desired location.

Figure 5:
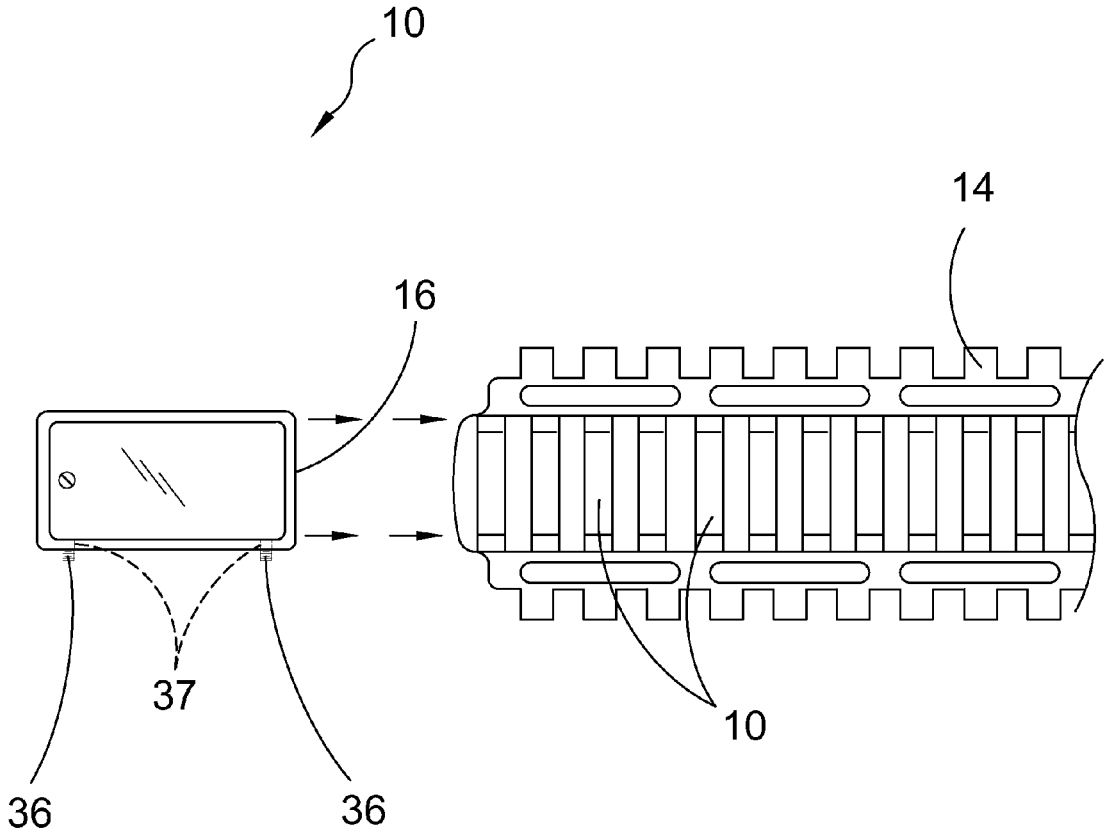
FIG. 5 is an orthographic view of the gun rail article of the present invention slidably mountable to a gun rail

FIG. 5 is an orthographic view of the gun rail article 10 of the present invention slidably mountable to a gun rail 14. The gun rail article 10 incorporates an article mounting channel 40 for mounting the gun rail article 10 onto the transverse channel ribs 42 of the gun rail 14 either by sliding the gun rail article 10 onto the gun rail 14 and securing it thereto with gun rail or by snapping the gun rail article 10 onto the transverse ribs 42. The gun rail article housing 16 incorporates side wall mounted fasteners 36 for fixing the gun rail article 10 to the gun rail 14 once positioned to a desired location.

Figure 6:
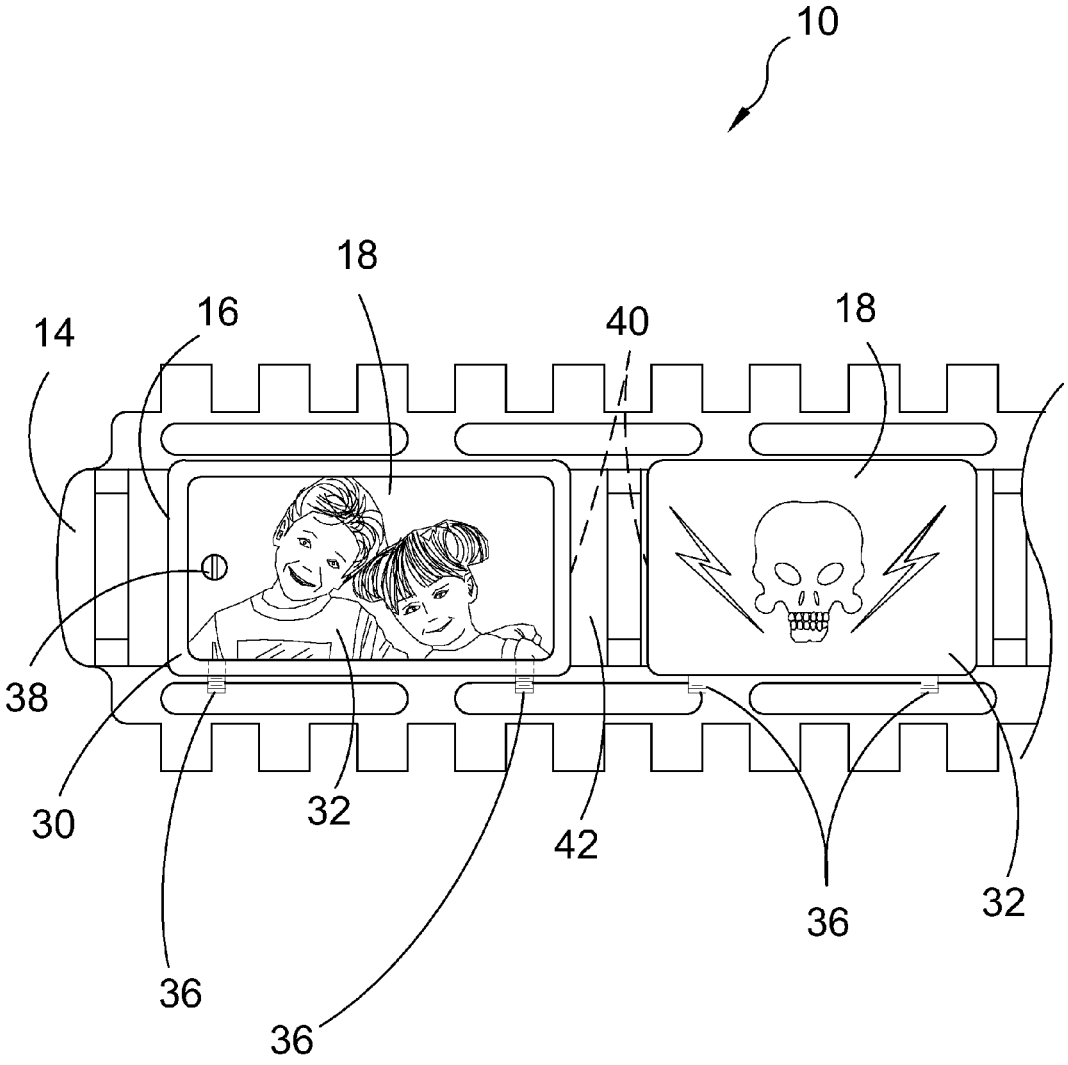
FIG. 6 is an illustrative view of a pair of embodiments of the gun rail mountable article of the present invention.

FIG. 6 is an illustrative view of the gun rail mountable article 10 of the present invention depicting a pair of embodiments of the design plate 32 used to identify or personalize any weapon using the Picatinny or Weaver rail system. The article comprises a housing 16 having an image portion 18 and an attachment portion wherein said image portion 18 has an image area and said attachment portion incorporates means for article attachment to a gun rail 14. The image area provides for a plurality of selectable reliefs where the relief may be separable from the attachment portion and fastenable thereto by fastener or an image portion receptacle that receives anything from military style dog tags to Velcro® patches or customized logos held within said receptacle by fastener. Also shown are side wall mounted gun rail attachment fasteners 36 that when fastened contact channel resident flexible tabs, shown in FIG. 7, thereby releasably fastening the gun rail article 10 to a gun rail 14. The article mounting channel 40 slides onto the transverse ribs 42 and affixed thereto by the gun rail attachment fasteners 36, preferably set screws. The design plate 32 resides within the receptacle ridge 30 of the image portion 18 and secured therein by a design plate fastener 38.

Figure 7:
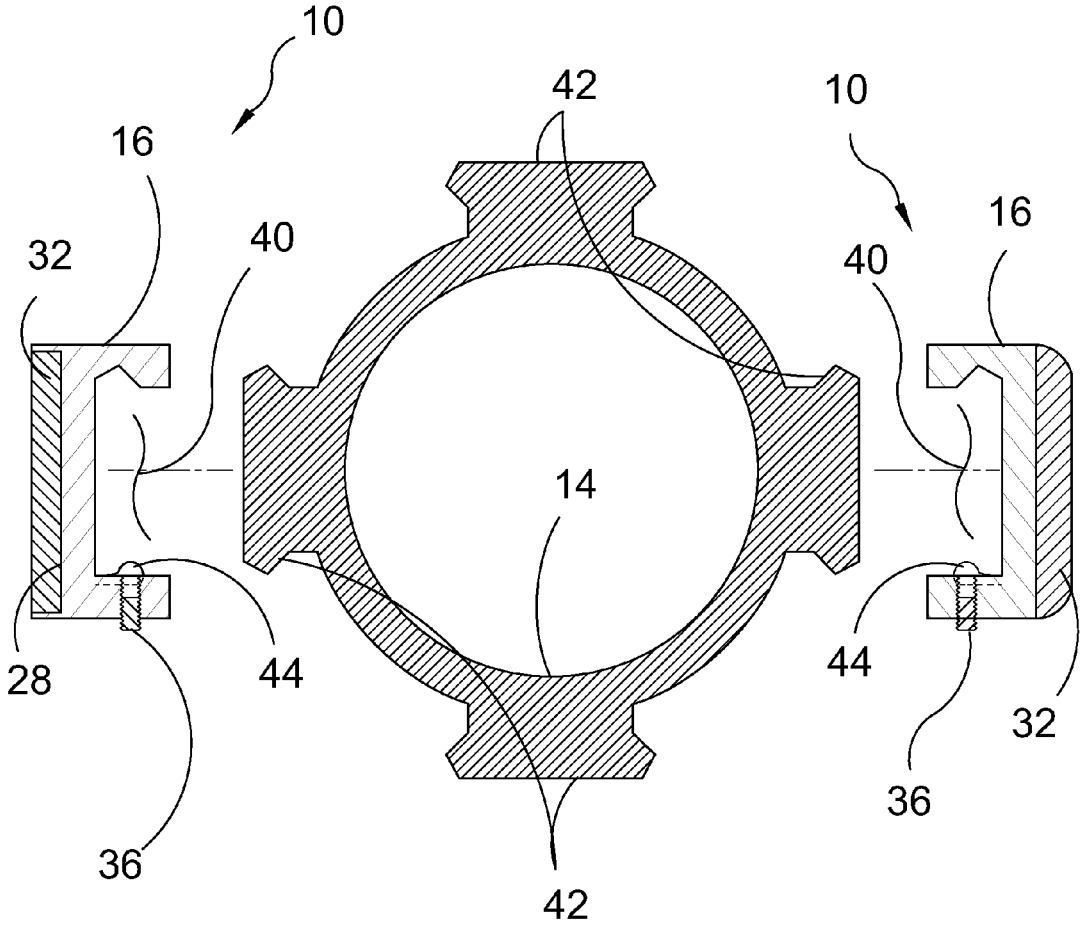
FIG. 7 is a sectional view of a pair of embodiments of the gun rail mountable article of the present invention.

FIG. 7 is a sectional view of a pair of embodiments of the gun rail mountable article 10 of the present invention. Illustrated is a sectional view of a gun rail 14 having a pair of gun rail articles 10 mountable to a gun rail 14 by sliding the article mounting channel 40 along the gun rail transverse ribs 42. The present invention also provides embodiments having channel resident transverse rails allowing for the gun rail article 10 to be snapped onto the gun rail 14 at a desired location. Embodiments of the gun rail mountable article 10 are used to identify or personalize any weapon using the Picatinny or Weaver rail system. Each illustrated gun rail article comprises housing having an image portion and a channeled bottom portion for attachment to a gun rail. The image portion provides for a plurality of selectable reliefs where the relief may be separable from the bottom portion and fastened thereto using fastener or permanently bonded, such as adhesively. Additionally provided for is an embodiment having an image area receptacle 28 that receives anything from military style dog tags to Velcro® patches or customized logos held within said receptacle 28 by fasteners. Gun rail attachment fasteners 36 are then fastened, which contact channel resident flexible tabs 44 thereby releasably fastening the gun rail articles 10 to the gun rail 14. Embodiments of the housing 16 provide for a releasable recessed design plate 32 and a flush mounted design plate 32.

Figure 8:
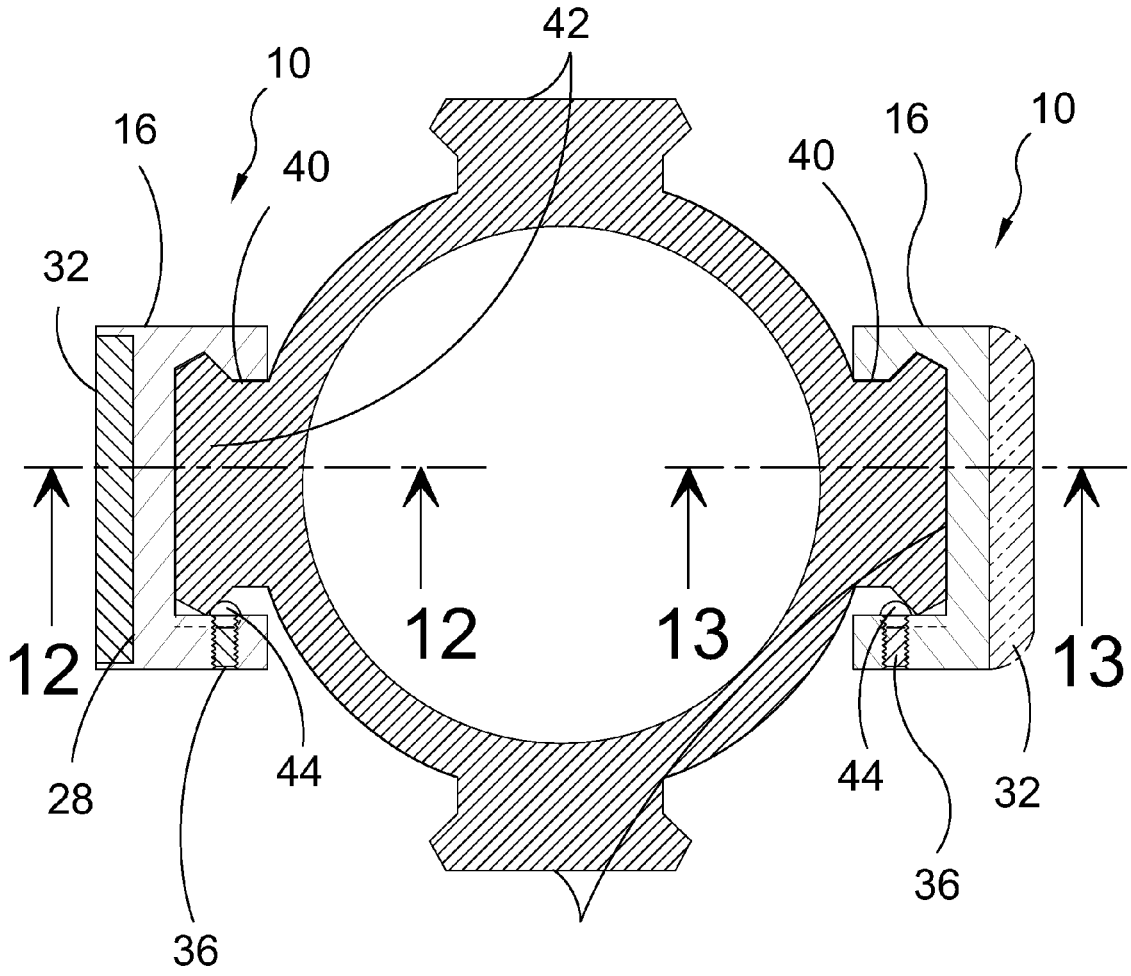
FIG. 8 is a sectional view of a mounted pair of embodiments of the gun rail mountable article of the present invention.

FIG. 8 is a sectional view of a mounted pair of embodiments of the gun rail mountable article 10 of the present invention. Illustrated is a sectional view of a gun rail 14 having a pair of gun rail articles 10 mountable to a gun rail 14 by sliding the article mounting channel 40 along the gun rail transverse ribs 42. The present invention also provides embodiments having channel resident transverse rails allowing for the gun rail article 10 to be snapped onto the gun rail 14 at a desired location. Embodiments of the gun rail mountable article 10 are used to identify or personalize any weapon using the Picatinny or Weaver rail system. Each illustrated gun rail article comprises housing having an image portion and a channeled bottom portion for attachment to a gun rail. The image portion provides for a plurality of selectable reliefs where the relief may be separable from the bottom portion and fastened thereto using fastener or permanently bonded, such as adhesively. Additionally provided for is an embodiment having an image area receptacle 28 that receives anything from military style dog tags to Velcro® patches or customized logos held within said receptacle 28 by fasteners. Gun rail attachment fasteners 36 are then fastened, which contact channel resident flexible tabs 44 thereby releasably fastening the gun rail articles 10 to the gun rail 14. Embodiments of the housing 16 provide for a releasable recessed design plate 32 and a flush mounted design plate 32.

Figure 9:
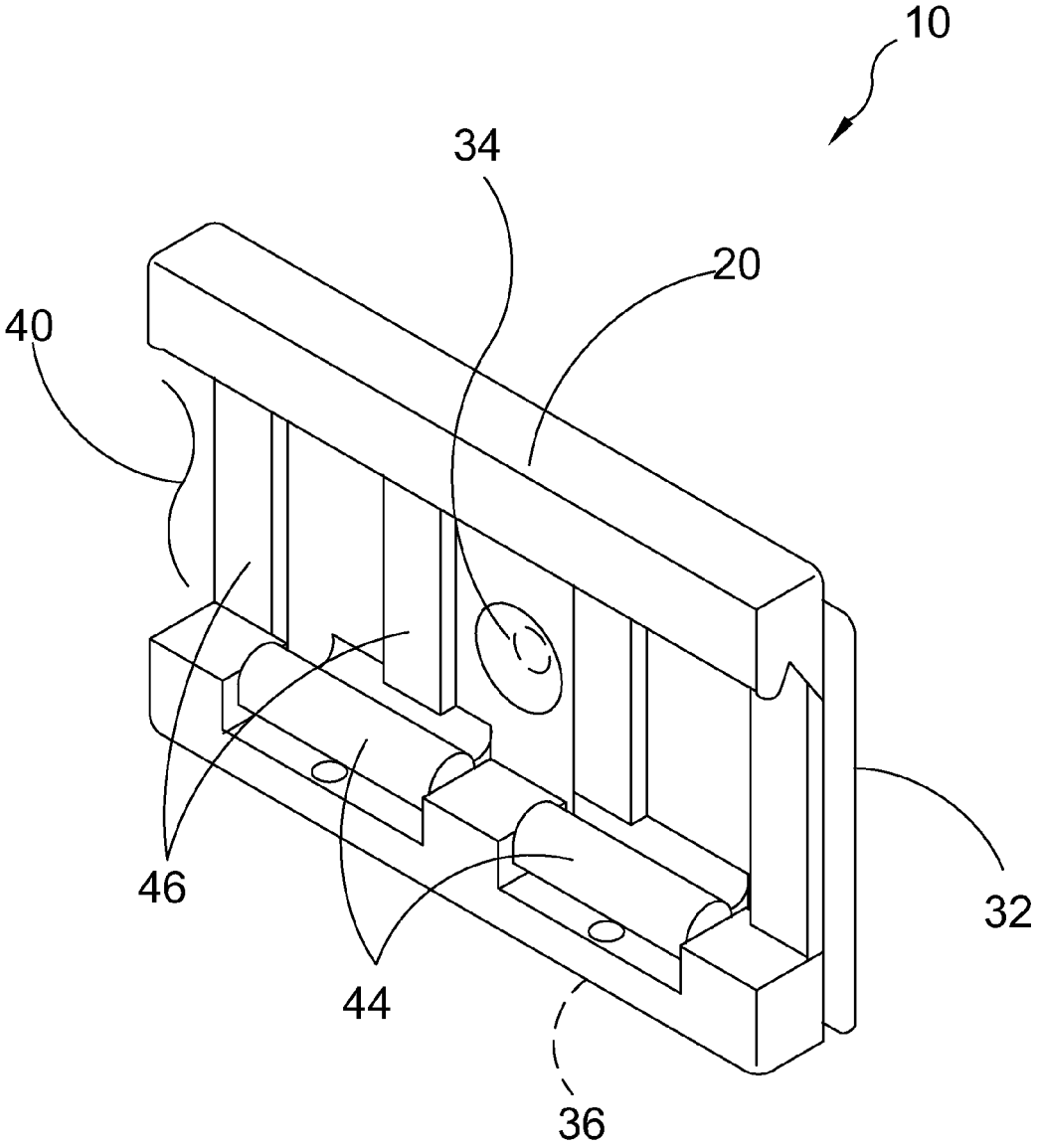
FIG. 9 is a rear view of the gun rail article of the present invention.

FIG. 9 is a rear view of the gun rail article 10 of the present invention. Shown is a rear view of the gun rail article attachment portion 20 comprised of channel mounting means for mounting the gun rail article 10 to a gun rail by snapping it thereto. The article ribs 46 may be incorporated for structural supports depending on the type of material and thickness. Also shown are channel resident flexible tabs 44 that lockingly engage the gun rail through fastening of gun rail attachment fasteners 36 and the article mounting channel 40. Additionally, as aforementioned, the image portion may be seperable from the attachment portion allowing for selective replacement of the design plate 32 of the gun rail article 10. Therefore the present invention provides a fastener aperture 34 for securing the design plate 32 to the attachment portion 20.

Figure 10:
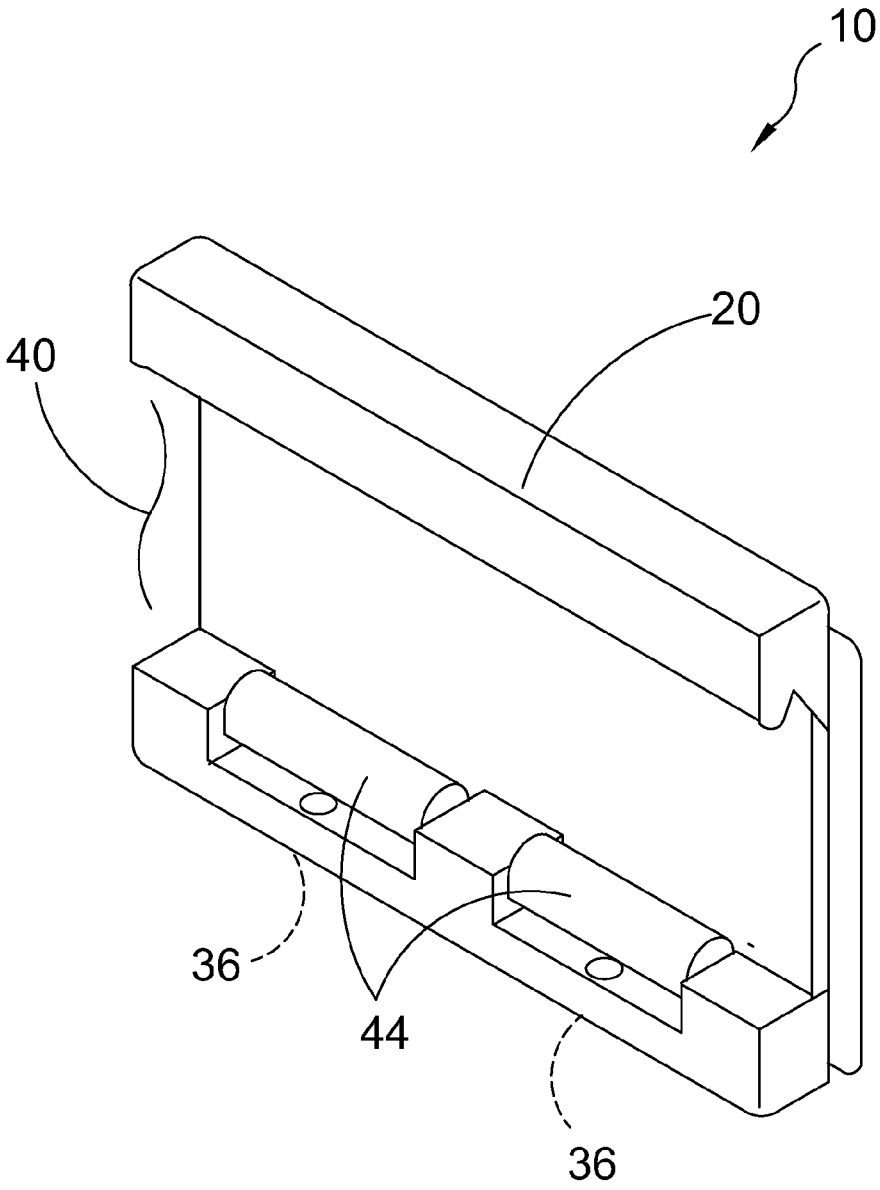
FIG. 10 is a rear view of the gun rail article of the present invention.

FIG. 10 is a rear view of the gun rail article 10 of the present invention. Shown is a rear view of the gun rail article attachment portion 20 comprised of an article mounting channel 40 for mounting the gun rail article 10 to a gun rail by sliding the gun rail article 10 onto the gun rail. Also shown are channel resident flexible tabs 44 that lockingly engage the gun rail through fastening of gun rail attachment fasteners 36.

Figure 11:
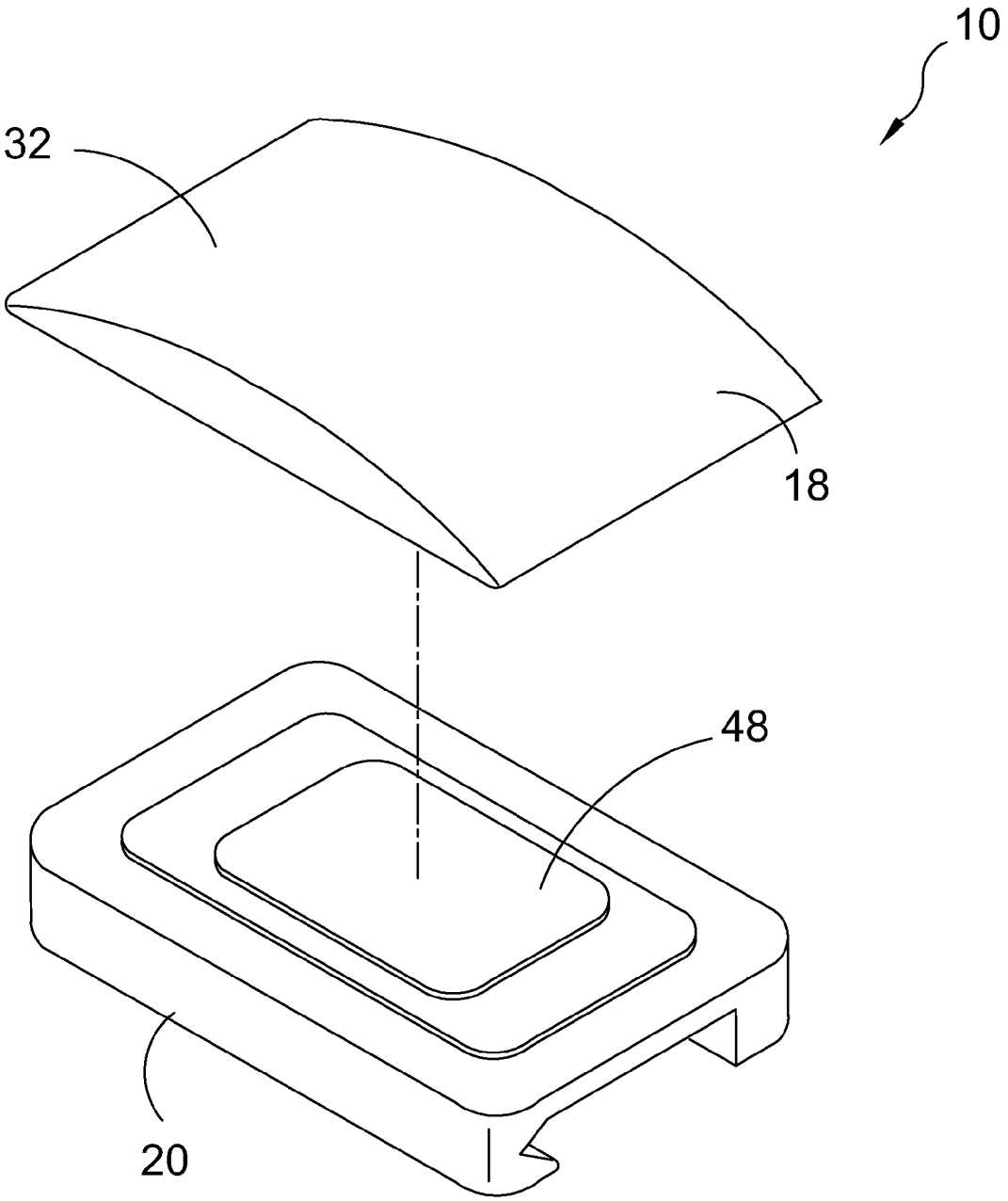
FIG. 11 is a perspective view of the gun rail article of the present invention.

FIG. 11 is a perspective view of the gun rail article 10 of the present invention. Shown is a perspective view of the gun rail article having an image portion 18 wherein the design plate 32 is flush mounted to the attachment portion 20. As previously shown, the design plate 32 may be seperable from the attachment portion 20 allowing for selective replacement thereof. Therefore the present invention provides an image portion fastener and attachment portion fastener aperture for securing the image portion 18 to the attachment portion 20. Alternately, the image portion 18 may be fixed to the attachment portion 20 through use of adhesive or other suitable bonding element 48.

FIGS. 12A and 12B a partial cross sectional view of the gun rail article 10 of the present invention. Shown is the gun rail article 10, taken from FIG. 8 as indicated, comprising a unitary article having a top side image portion and a bottom side attachment portion. Depicted is the unitary embodiment providing for the gun rail article 10 having ribs 46 providing for snapping the gun rail article 10 onto the gun rail 14 and an embodiment without ribs, which can be slid onto the gun rail 14.

FIGS. 13A and 13B are partial cross sectional views of the gun rail mountable article 10 of the present invention taken from FIG. 8 as indicated, showing the article 10 comprising an image portion 18 being a flush mounted design plate 32 separable from the attachment portion 20 allowing for selective replacement of the image portion 18 of the gun rail article 18 through a fastener aperture 32 and fastener for securing the image portion to the attachment portion prior to attachment to the gun rail 14.

What is claimed is new and desired to be protected by Letters Patent is set forth in the appended claims:

1. A gun rail mountable article comprising:

a) a housing having an attachment portion and an image portion, said attachment portion having an upper flange with a beveled descending distal end adapted to extend into a mounting channel of said gun rail and a perpendicular lower flange with a flat surface defining an article mounting channel therebetween, said flat surface having flexible tabs having an arcuate shape extending outwardly from said flat surface allowing said attachment portion to attach to said gun rail by either sliding said attachment portion onto the gun rail or by snapping said attachment portion onto the gun rail;

b) said image portion for displaying a design plate having an image or item, said design plate having a single fastener aperture for mounting to said image portion; and c) a pair of mating fastener apertures at opposite ends of said image portion each co-aligned with said design plate fastener element aperture so that said design plate can be rotated 180 degrees and fastened to either fastener aperture whereby said housing can be mounted on a left side or right side gun rail to accommodate viewing the design plate in a desired orientation.

2. The gun rail mountable article according to claim 1, wherein said image portion comprises an image portion receptacle defined by a receptacle ridge projecting peripherally from said housing.

3. The gun rail mountable article according to claim 1, having gun rail attachment fastener elements which when-tightened provide a bias urging said flexible tabs to apply pressure to said gun rail.

4. The gun rail mountable article according to claim 1, wherein said image portion is an independent design plate that is flush mounted to said attachment portion.

5. An ornamental article mountable to, and in combination with, the gun rail of a weapon comprising:

a) a housing comprising:

i) an image portion having a peripherally projecting receptacle ridge defining an image portion receptacle; and ii) an attachment portion having an upper flange with a beveled descending distal end adapted to extend into a mounting channel of said gun rail and a perpendicular lower flange with a flat surface defining an article mounting channel therebetween, said flat surface having flexible tabs having an arcuate shape extending outwardly from said flat surface allowing said attachment portion to attach to said gun rail by either sliding said attachment portion onto the gun rail or by snapping said the attachment portion onto the gun rail;

b) a plurality of selectable design plates having a single fastener aperture for mounting to said image portion;

c) a pair of mating fastener apertures at opposite ends of said housing each co-aligned with said design plate fastener element aperture disposed in said housing extending through said attachment portion and said image portion so that said design plate can be rotated 180 degrees and fastened to either fastener aperture whereby said housing can be mounted on a left side or right side gun rail to accommodate viewing the design plate in a desired orientation; and d) a design plate fastener element to thread through said co-aligned fastener apertures to secure said design plate within said image portion.

6. The ornamental article mountable to a gun rail according to claim 5, wherein said attachment portion further comprises a pair of threaded gun rail fastener apertures in said lower flange with set screws terminating at said flexible tabs disposed proximal said article mounting channel wherein tightening said set screws provides a bias urging said tabs against the transverse channel ribs of said gun rail to secure said article in a selected position.

* * * * *